US009455506B2

(12) United States Patent
Kerner

(10) Patent No.: US 9,455,506 B2
(45) Date of Patent: Sep. 27, 2016

(54) ELECTRICAL CONNECTOR FOR ADJUSTABLE REFRIGERATOR SHELF

(71) Applicant: Whirlpool Corporation, Benton Harbor, MI (US)

(72) Inventor: James Kerner, Indianapolis, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/623,021

(22) Filed: Feb. 16, 2015

(65) Prior Publication Data

US 2015/0162672 A1 Jun. 11, 2015

Related U.S. Application Data

(63) Continuation of application No. 13/761,800, filed on Feb. 7, 2013, now Pat. No. 8,967,740.

(51) Int. Cl.

| | |
|---|---|
| ***H01R 4/64*** | (2006.01) |
| ***H01R 43/00*** | (2006.01) |
| ***F25D 25/02*** | (2006.01) |
| ***F25D 27/00*** | (2006.01) |
| ***F25D 23/00*** | (2006.01) |

(Continued)

(52) U.S. Cl.

CPC ..... *H01R 4/64* (2013.01); *A47B 96/027* (2013.01); *F25D 23/00* (2013.01); *F25D 25/02* (2013.01); *F25D 25/024* (2013.01); *F25D 25/028* (2013.01); *F25D 27/005* (2013.01); *H01R 13/701* (2013.01); *H01R 25/162* (2013.01); *H01R 43/00* (2013.01); *F25D 23/067* (2013.01); *Y10T 29/49117* (2015.01)

(58) Field of Classification Search

USPC ..... 439/116, 817, 724, 631; 108/23; 362/94, 92; 312/408

See application file for complete search history.

(56) References Cited

U.S. PATENT DOCUMENTS

| | | | |
|---|---|---|---|
| 2,704,838 | A | 3/1955 | Macha et al. |
| 3,044,035 | A | 7/1962 | Adams, Jr. |

(Continued)

FOREIGN PATENT DOCUMENTS

| | | |
|---|---|---|
| DE | 202012008355 U1 | 10/2012 |
| WO | 2008151720 | 12/2008 |

(Continued)

OTHER PUBLICATIONS

European search report, Nov. 19, 2015, 12 pages.

*Primary Examiner* — Alexander Gilman

(57) ABSTRACT

A refrigerator appliance may include a cabinet having a temperature-controlled compartment defined therein, a shelf ladder disposed in the temperature-controlled compartment and providing a plurality of shelf mounting positions, an electrical connector corresponding to each of the plurality of shelf mounting positions, wherein each of the electrical connectors comprises an actuator movable from a first position to a second position and an electrical contact configured to automatically move from a disengaged position to an engaged position in response to the actuator moving from the first position to the second position, and an adjustable shelf removably mountable in one of the plurality of shelf mounting positions such that the actuator of the corresponding electrical connector is held in the second position by a weight of the adjustable shelf and the electrical contact of the corresponding electrical connector engages the adjustable shelf.

20 Claims, 6 Drawing Sheets

(51) Int. Cl.

| | |
|---|---|
| ***A47B 96/02*** | (2006.01) |
| ***H01R 25/16*** | (2006.01) |
| ***H01R 13/70*** | (2006.01) |
| *F25D 23/06* | (2006.01) |

(56) References Cited

U.S. PATENT DOCUMENTS

| | | | | |
|---|---|---|---|---|
| 3,181,102 | A | | 4/1965 | Fehr, Jr. |
| 3,231,732 | A | * | 1/1966 | Ferguson, Jr. ..... 362/94 |
| 3,356,328 | A | * | 12/1967 | Sachau ..... 248/245 |
| 3,506,325 | A | * | 4/1970 | Horvay ..... 312/223.5 |
| 3,814,492 | A | * | 6/1974 | Jacobs ..... 312/273 |
| 3,885,846 | A | * | 5/1975 | Chuang et al. ..... 312/306 |
| 4,029,378 | A | | 6/1977 | Bolis |
| 4,637,677 | A | * | 1/1987 | Barkus ..... 439/724 |
| 4,657,333 | A | * | 4/1987 | Anderson ..... 439/650 |
| 4,689,726 | A | * | 8/1987 | Kretzschmar ..... 362/127 |
| 4,690,483 | A | * | 9/1987 | Carris ..... 439/517 |
| 4,974,121 | A | | 11/1990 | Masuko et al. |
| 5,034,861 | A | | 7/1991 | Sklenak et al. |
| 5,287,252 | A | | 2/1994 | Caruso |
| 5,348,485 | A | | 9/1994 | Briechle et al. |
| 5,376,025 | A | * | 12/1994 | Willnat et al. ..... 439/817 |
| 5,403,083 | A | | 4/1995 | Dasher et al. |
| 5,425,648 | A | * | 6/1995 | Farham ..... 439/116 |
| 5,460,546 | A | * | 10/1995 | Kunishi et al. ..... 439/631 |
| 5,550,361 | A | | 8/1996 | Huis et al. |
| 5,600,310 | A | | 2/1997 | Whipple, III et al. |
| 5,685,748 | A | * | 11/1997 | Harting et al. ..... 439/862 |
| 5,690,415 | A | * | 11/1997 | Krehl ..... 362/125 |
| 5,758,585 | A | * | 6/1998 | Latchinian ..... 108/23 |
| 6,042,244 | A | | 3/2000 | Witkoski |
| 6,065,821 | A | * | 5/2000 | Anderson et al. ..... 312/408 |
| 6,120,304 | A | * | 9/2000 | Harwood et al. ..... 439/92 |
| 6,200,146 | B1 | | 3/2001 | Sarkissian |
| 6,231,205 | B1 | | 5/2001 | Slesinger et al. |
| 6,786,562 | B2 | | 9/2004 | Obrock et al. |
| 6,813,896 | B1 | | 11/2004 | Janke et al. |
| 7,107,779 | B2 | | 9/2006 | Avenwedde et al. |
| 7,163,305 | B2 | * | 1/2007 | Bienick ..... 362/92 |
| 7,165,977 | B2 | | 1/2007 | Jiang et al. |
| 7,178,941 | B2 | | 2/2007 | Roberge et al. |
| 7,338,180 | B2 | * | 3/2008 | Wing ..... 362/92 |
| 7,434,951 | B2 | | 10/2008 | Bienick |
| 7,744,252 | B2 | | 6/2010 | Maxik |
| 7,748,806 | B2 | * | 7/2010 | Egan ..... 312/408 |
| 7,766,502 | B2 | | 8/2010 | Tress |
| 7,840,286 | B2 | * | 11/2010 | Caldwell et al. ..... 700/17 |
| 8,044,415 | B2 | | 10/2011 | Messere et al. |
| 8,152,258 | B2 | * | 4/2012 | Kang et al. ..... 312/408 |
| 8,419,143 | B2 | * | 4/2013 | Shin et al. ..... 312/408 |
| 8,657,392 | B2 | * | 2/2014 | Fabbro et al. ..... 312/408 |
| 8,739,568 | B2 | * | 6/2014 | Allard et al. ..... 62/448 |
| 8,967,740 | B2 | * | 3/2015 | Kerner ..... 312/237 |
| 9,157,678 | B2 | * | 10/2015 | Kerner |
| 2003/0038571 | A1 | * | 2/2003 | Obrock et al. ..... 312/408 |
| 2006/0228913 | A1 | | 10/2006 | Jiang et al. |
| 2007/0139909 | A1 | | 6/2007 | Wing |
| 2007/0145915 | A1 | | 6/2007 | Roberge |
| 2008/0043456 | A1 | | 2/2008 | Bernardini |
| 2008/0121146 | A1 | | 5/2008 | Burns et al. |
| 2008/0278932 | A1 | | 11/2008 | Tress |
| 2009/0021927 | A1 | | 1/2009 | Hall |
| 2011/0121654 | A1 | | 5/2011 | Recker |
| 2011/0133655 | A1 | | 6/2011 | Recker |
| 2011/0164399 | A1 | * | 7/2011 | Driver et al. ..... 362/92 |
| 2011/0273867 | A1 | | 11/2011 | Horst et al. |
| 2013/0188338 | A1 | | 7/2013 | Melhaff |
| 2013/0286651 | A1 | | 10/2013 | Takeuchi |

FOREIGN PATENT DOCUMENTS

| | | |
|---|---|---|
| WO | 2010133478 A2 | 11/2010 |
| WO | 2013087081 | 6/2013 |
| WO | 2014032190 | 3/2014 |

* cited by examiner

ELECTRICAL CONNECTOR FOR ADJUSTABLE REFRIGERATOR SHELF

CROSS-REFERENCE TO RELATED APPLICATIONS

This application is a continuation of application Ser. No. 13/761,800, filed on Feb. 7, 2013, entitled ELECTRICAL CONNECTOR FOR ADJUSTABLE REFRIGERATOR SHELF, the entire disclosure of which is hereby incorporated by reference.

TECHNICAL FIELD

The present disclosure relates, generally, to refrigerator appliances and, more particularly, to systems and methods for powering lighted shelves in refrigerator appliances.

BACKGROUND

A refrigerator is an appliance used to store food items at preset temperatures. A refrigerator appliance typically includes one or more temperature-controlled compartments into which food items may be placed to preserve the food items for later consumption. A refrigerator appliance also typically includes a plurality of shelves on which the food items may be arranged within the one or more temperature-controlled compartments. In some refrigerator appliances, the plurality of shelves may be adjustable (i.e., the shelves may each be removably mounted in a plurality of shelf mounting positions). Some or all of the plurality of shelves may also carry one or more lighting devices for illuminating food items placed in the one or more temperature-controlled compartments.

SUMMARY

According to one aspect, a refrigerator appliance may include a cabinet having a temperature-controlled compartment defined therein, a shelf ladder disposed in the temperature-controlled compartment and providing a plurality of shelf mounting positions, an electrical connector corresponding to each of the plurality of shelf mounting positions, wherein each of the electrical connectors comprises an actuator movable from a first position to a second position and an electrical contact configured to automatically move from a disengaged position to an engaged position in response to the actuator moving from the first position to the second position, and an adjustable shelf removably mountable in one of the plurality of shelf mounting positions such that the actuator of the corresponding electrical connector is held in the second position by a weight of the adjustable shelf and the electrical contact of the corresponding electrical connector engages the adjustable shelf.

In some embodiments, each of the electrical connectors may further include a resilient member that biases the actuator toward the first position, the resilient member being deformable by the weight of the adjustable shelf. The adjustable shelf may include a mounting bracket configured to be cantilevered on the shelf ladder, and the mounting bracket may include a tab configured to extend through a slot formed in the shelf ladder to engage the corresponding electrical connector. A first surface of the tab that is configured to engage the actuator of the corresponding electrical connector and a second surface of the tab that is configured to interface with the electrical contact of the corresponding electrical connector may be perpendicular to one another.

In some embodiments, each of the electrical connectors may further include an additional electrical contact configured to automatically move from the disengaged position to the engaged position in response to the actuator moving from the first position to the second position. The electrical contact and the additional electrical contact may be configured to supply power at different current levels. The tab of the mounting bracket may include at least two conductors configured to interface with the electrical contact and the additional electrical contact of the corresponding electrical connector.

According to another aspect, an electrical connector for an adjustable refrigerator shelf may include a first lever having a first end and a second end opposite the first end, the first lever being movable from a first position to a second position when a mounting bracket of the adjustable refrigerator shelf engages the first lever, and a second lever having a first section and a second section disposed at an angle to the first section, the second lever being movable from a disengaged position to an engaged position in which a first electrical contact carried by the second section engages the mounting bracket to supply power to the adjustable refrigerator shelf, wherein the first end of the first lever is coupled to the first section of the second lever such that movement of the first lever from the first position to the second position causes movement of the second lever from the disengaged position to the engaged position.

In some embodiments, the electrical connector may further include a resilient member that biases the first lever toward the first position. The first end of the first lever may include a protrusion extending therefrom which engages a track formed in the first section of the second lever.

In some embodiments, a housing supporting the electrical connector may be coupled to a shelf ladder having a slot formed therein. The first electrical contact carried by the second section of the second lever may be configured to interface with a first conductor carried by a tab of the mounting bracket that extends through the slot when the mounting bracket is cantilevered on the shelf ladder. The first lever may be pivotably coupled to the housing at the second end of the first lever, and the second lever may be pivotably coupled to the housing at a location where the first and second sections of the second lever meet.

In some embodiments, the electrical connector may further include a second electrical contact carried by the second section of the second lever. The second electrical contact may be configured to interface with a second conductor carried by the tab when the mounting bracket is cantilevered on the shelf ladder. The first and second electrical contacts may be configured to supply power to the adjustable refrigerator shelf at different current levels.

According to yet another aspect, a method may include removably mounting an adjustable shelf in a temperature-controlled compartment of a refrigerator such that a weight of the adjustable shelf rests against an actuator disposed in the refrigerator, wherein the weight of the adjustable shelf causes the actuator to move from a first position to a second position, and automatically moving an electrical contact from a disengaged position to an engaged position in response to the actuator moving from the first position to the second position, wherein the electrical contact supplies power to the adjustable shelf when in the engaged position.

In some embodiments, removably mounting the adjustable shelf in the temperature-controlled compartment of the refrigerator may include cantilevering a mounting bracket of the adjustable shelf on a shelf ladder disposed in the temperature-controlled compartment, where the actuator is disposed behind the shelf ladder. Cantilevering the mounting bracket of the adjustable shelf on the shelf ladder may cause a tab of the mounting bracket to extend through a slot formed in the shelf ladder and to engage the actuator. A first surface of the tab that is configured to engage the actuator and a second surface of the tab that is configured to interface with the electrical contact when in the engaged position may be perpendicular to one another.

In some embodiments, automatically moving the electrical contact from the disengaged position to the engaged position may include pivoting a first lever carrying the electrical contact, wherein the actuator comprises a second lever coupled to the first lever. The method may further include automatically moving an additional electrical contact from the disengaged position to the engaged position in response to the actuator moving from the first position to the second position, wherein the additional electrical contact supplies power to the adjustable shelf when in the engaged position. The electrical contact and the additional electrical contact may supply power at different current levels.

In some embodiments, the method may further include removing the weight of the adjustable shelf from the actuator such that the actuator moves from the second position to the first position under the influence of a resilient member that biases the actuator toward the first position and automatically moving the electrical contact from the engaged position to the disengaged position in response to the actuator moving from the second position to the first position, wherein the electrical contact remains clear of the adjustable shelf when in the disengaged position.

BRIEF DESCRIPTION OF THE DRAWINGS

The detailed description particularly refers to the following figures, in which.

Figure 1:
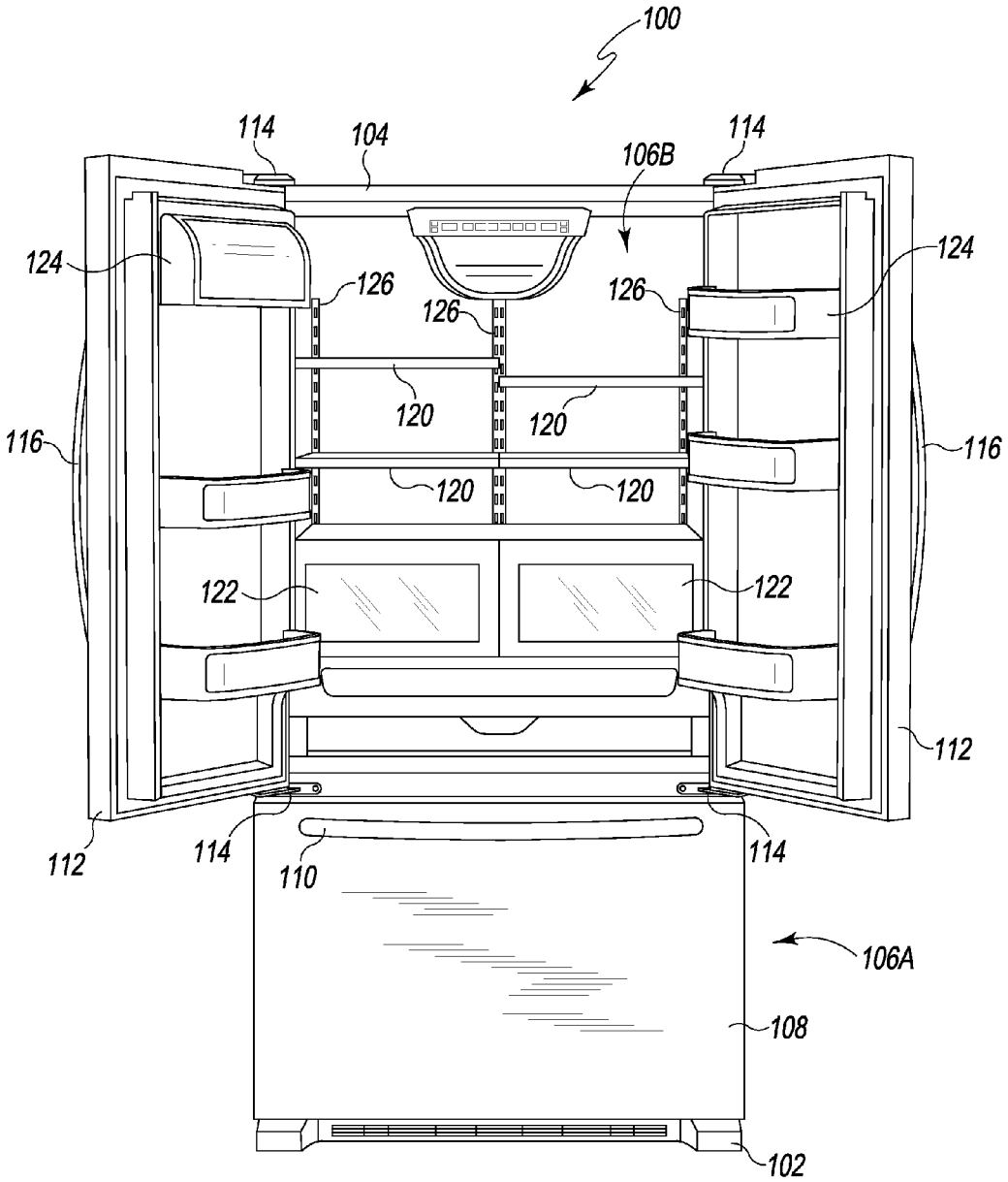
FIG. 1 is a front elevation view of a refrigerator appliance showing a number of adjustable shelves removably mounted in a plurality of shelf mounting positions within a temperature-controlled compartment of the refrigerator appliance.

Where considered appropriate, reference labels have been repeated among the figures to indicate corresponding or analogous elements.

DETAILED DESCRIPTION OF THE DRAWINGS

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a refrigerator appliance 100 (hereinafter, the refrigerator 100). One illustrative example of the refrigerator 100 is the Whirlpool Latitude French Door Refrigerator, which is commercially available from Whirlpool Corporation of Benton Harbor, Mich. The refrigerator 100 includes a lower frame 102 and a cabinet 104 extending upwardly from the lower frame 102. The cabinet 104 of the refrigerator 100 includes a pair of temperature-controlled compartments 106 that are independently operable to maintain food items stored therein at one or more set temperatures.

The lower temperature-controlled compartment 106 is a freezer compartment 106A, and the refrigerator 100 includes a drawer 108 that is positioned in the freezer compartment 106A. The drawer 108 is moveable relative to the cabinet 104 such that food items may be placed in the drawer 108 for storage in the freezer compartment 106A and retrieved from the drawer 108 when ready for use. A handle 110 is located on the drawer 108 so that a user may open and close the drawer 108.

The upper temperature-controlled compartment 106 is a refrigerated compartment 106B into which a user may place and store food items such as milk, cheese, produce, etcetera. A pair of doors 112 are each hinged to the front of the cabinet 104 via a pair of hinge assemblies 114. The doors 112 permit user access to the refrigerated compartment 106B such that food items may be placed in and retrieved from the refrigerated compartment 106B. A handle 116 is located on each of the doors 112 so that a user may open and close the doors 112.

While the illustrative embodiment of the refrigerator 100 shown in FIG. 1 is a "french-door" model with a pair of doors 112 operable to permit access to the refrigerated compartment 106B, it should be appreciated that other configurations are contemplated, such as, for example, configurations having only one door 112 operable to permit access to the refrigerated compartment 106B. Additionally, it should also be appreciated that, in some embodiments, the freezer compartment 106A may be positioned above the refrigerated compartment 106B and, in other embodiments, either one of the temperature-controlled compartments 106 may be omitted. It should be further appreciated that, in some embodiments, the refrigerator 100 may include more than one freezer compartment 106A and/or more than one refrigerated compartment 106B. Configurations of the refrigerator 100 are also contemplated in which the freezer compartment 106A is located on one side of the cabinet 104 and the refrigerated compartment 106B is located on the opposite side of the cabinet 104.

As shown in FIG. 1, the refrigerator 100 also includes four adjustable shelves 120 removably mounted within the refrigerated compartment 106B, upon which a user of the refrigerator 100 may arrange food items. It is contemplated that the refrigerator 100 may include any number of adjustable shelves 120 within the temperature-controlled compartments 106. As the adjustable shelves 120 are removably mounted within the refrigerated compartment 106B, a user may remove any adjustable shelf 120 and relocate it to any available shelf mounting position within the refrigerated compartment 106B. It will be appreciated that the refrigerator 100 may additionally or alternatively include other devices for supporting or storing food within the temperature-controlled compartments 106, such as, for example, drawers 122 or door bins 124 (as shown in FIG. 1). As used in the present disclosure, the term "shelf" is to be considered in its broadest sense as any device that will hold a food item, including shelves, drawers, bins, panels, racks, and the like.

The adjustable shelves 120 may be removably mounted within the refrigerated compartment 106B using any suitable mechanism. In the illustrative embodiment of the refrigerator 100 shown in FIG. 1, three shelf ladders 126 are disposed within the refrigerated compartment 106B to provide a plurality of shelf mounting positions for the adjustable shelves 120. It is contemplated that any number of shelf ladders 126 may be used for removably mounting the adjustable shelves 120. In some embodiments, the shelf ladders 126 may be secured to one or more walls of the refrigerator compartment 106B using screws, bolts, rivets, adhesive, or other fixation mechanisms. In other embodiments, the shelf ladders 126 may be integrally formed into one or more walls of the refrigerator compartment 106B. It should also be appreciated that the adjustable shelves 120 may be removably mounted within the refrigerated compartment 106B using any number of mechanisms other than the shelf ladders 126. By way of example, the adjustable shelves 120 may be removably mounted within the refrigerated compartment 106B using ledges, tracks, slides, glides, rollers, and the like.

Figure 2A:
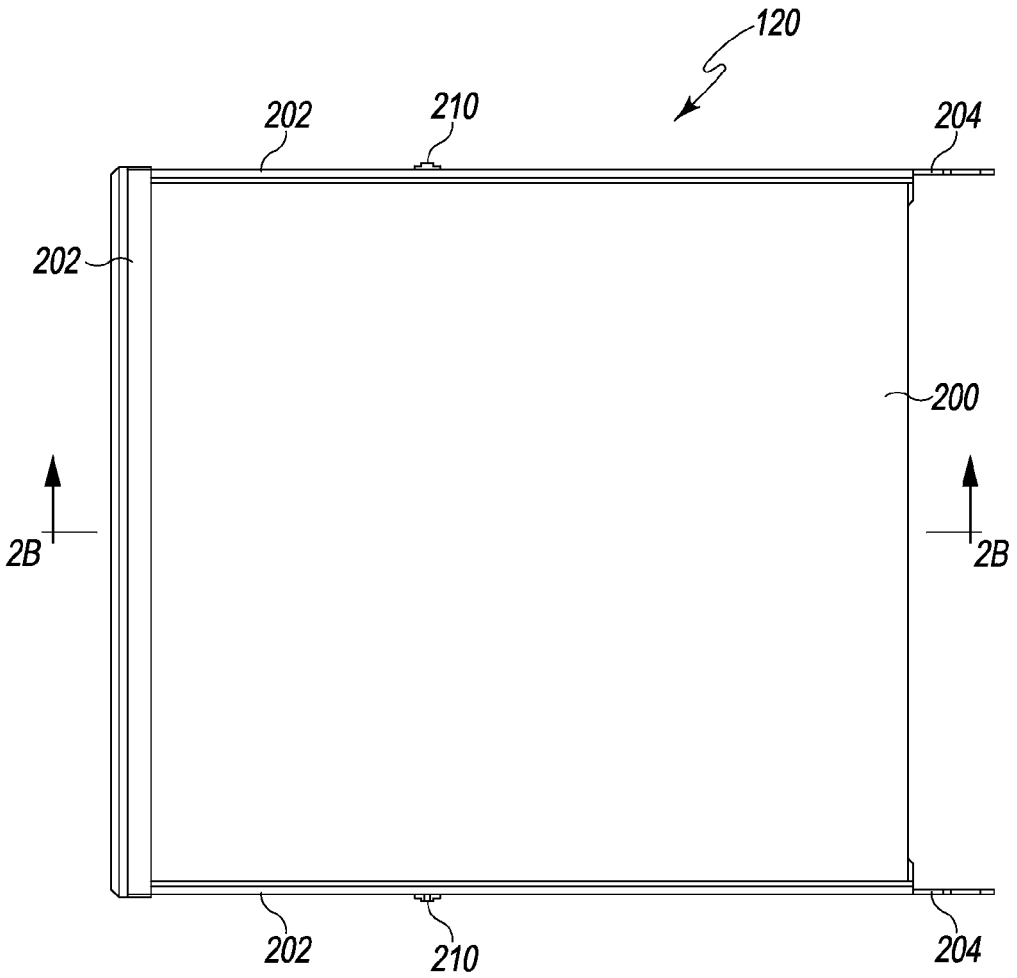
FIG. 2A is top plan view of one embodiment of an adjustable shelf that is removably mountable in the refrigerator appliance of FIG. 1.
Figure 2B:
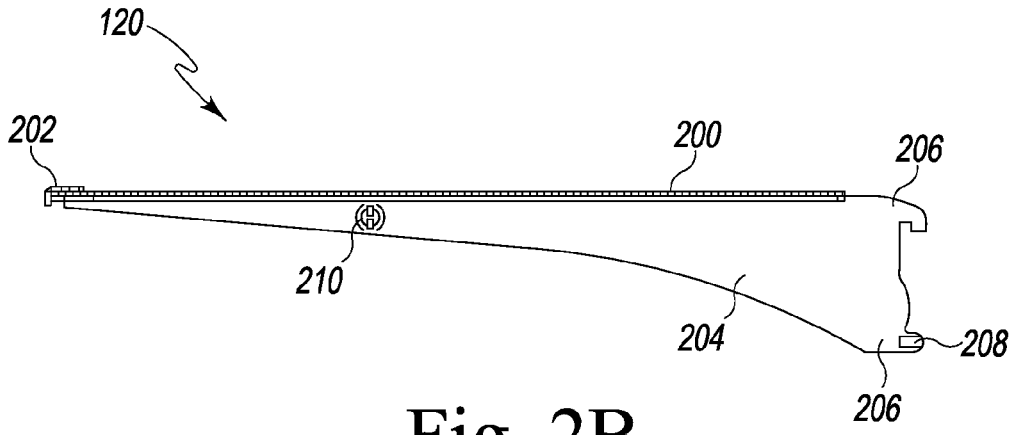
FIG. 2B is a cross-sectional view of the adjustable shelf of FIG. 2A, taken along the line 2B-2B in FIG. 2A.

One illustrative embodiment of an adjustable shelf 120 that is removably mountable within the refrigerated compartment 106B is shown in FIGS. 2A and 2B. The adjustable shelf 120 includes a support surface 200 upon which a user of the refrigerator 100 may arrange food items. The support surface 200 may illustratively be formed of glass, plastic, or any other suitable material. As shown in FIGS. 2A and 2B, the support surface 200 is illustratively bounded on three sides by lips 202, which assist in retaining food items arranged on the support surface 200 of the adjustable shelf 120.

In the illustrative embodiment, the adjustable shelf 120 includes a pair of mounting brackets 204 that are spaced apart from one another the same distance as a pair of the shelf ladders 126 of the refrigerator 100. As described further below (with reference to FIG. 3), these mounting brackets 204 allow the adjustable shelf 120 to be removably mounted on a pair of the shelf ladders 126. As illustrated in FIG. 2B, each of the mounting brackets 204 of the adjustable shelf 120 may include a body and a number of tabs 206 configured to engage a number of slots of one of the shelf ladders 126. In some embodiments, the mounting bracket 204 may include multiple upper tabs 206 and/or multiple lower tabs 206 extending from the body of the mounting bracket 204. Any of the tabs 206 of the mounting bracket 204 may include one or more conductors 208 disposed on or integrated into the tab 206. Where one of the tabs 206 carries a conductor 208, the tab 206 may be electrically isolated from the body of the mounting bracket 204 (particularly, where the mounting bracket 204 is formed of a conductive material, such as steel).

Some or all of the adjustable shelves 120 may carry one or more lighting devices 210 for illuminating food items placed in the refrigerated compartment 106B. For instance, each of the adjustable shelves 120 may carry one or more light emitting diodes (LEDs) 210. It is contemplated that, in some embodiments, some of the adjustable shelves 120 of the refrigerator 100 may not carry a lighting device (i.e., the refrigerator 100 may include both lighted and non-lighted adjustable shelves 120). Each lighting device 210 carried by an adjustable shelf 120 may be electrically coupled to a conductor 208 carried by one of the tabs 206 of a mounting bracket 204 of the adjustable shelf 120. As described further below, the conductor 208 may be electrically coupled to an electrical connector disposed behind one of the shelf ladders 126 when the adjustable shelf 120 is removably mounted in the refrigerated compartment 106B. As such, the corresponding lighting device 210 will also be electrically coupled to the electrical connector when the adjustable shelf is removably mounted in the refrigerated compartment 106B.

Figure 3:
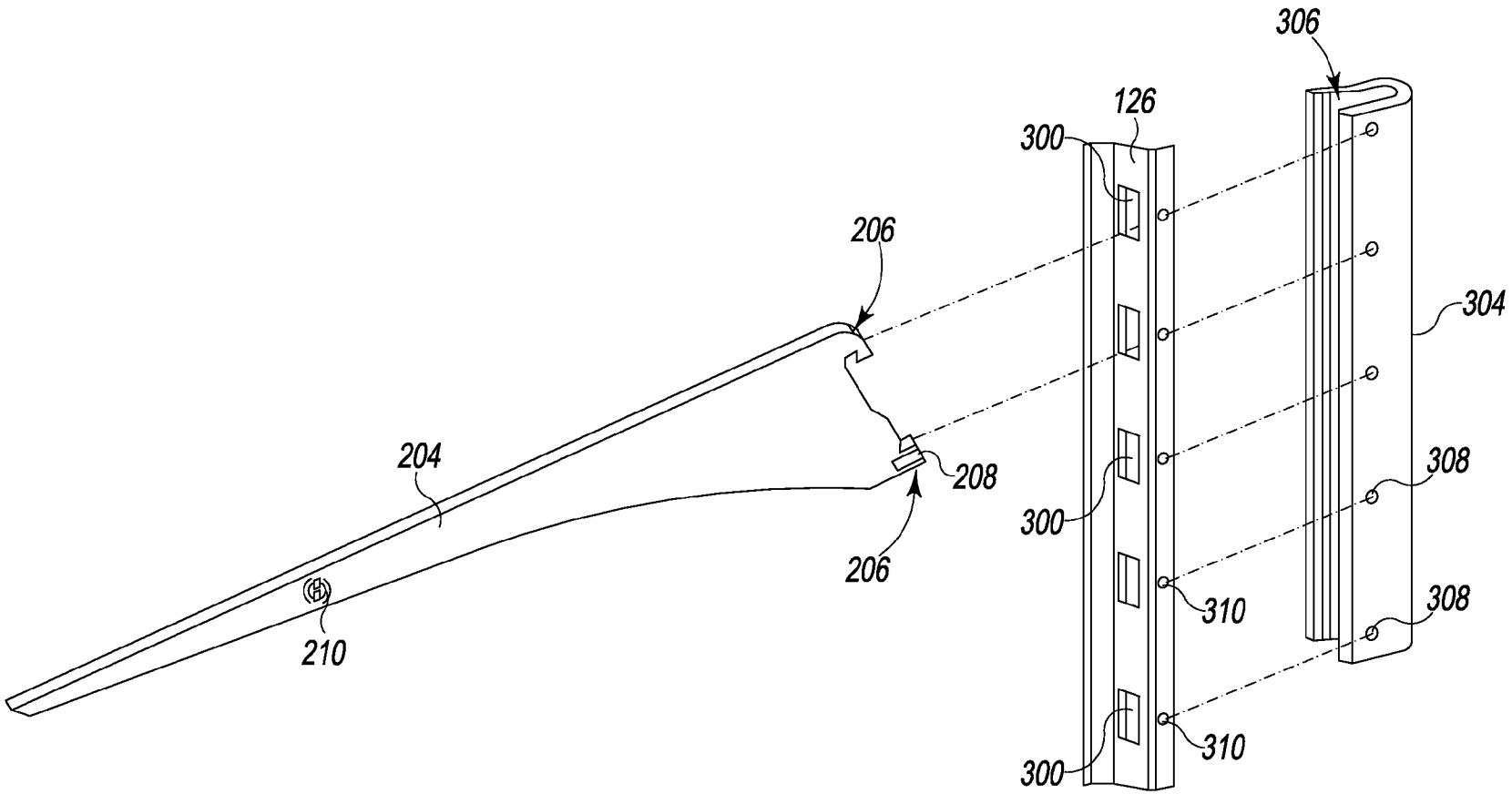
FIG. 3 is a partially exploded view of one embodiment of a shelf ladder, a housing supporting a number of electrical connectors, and a mounting bracket of the refrigerator appliance of FIG. 1.

As shown in more detail in FIG. 3, each of the shelf ladders 126 in the illustrative embodiment of refrigerator 100 has a number of slots 300 formed therein. As described above, each of the adjustable shelves 120 may illustratively include a pair of mounting brackets 204 that are spaced apart from one another the same distance as a pair of the shelf ladders 126 (only one such mounting bracket 204 being shown in FIG. 3). The mounting brackets 204 of an adjustable shelf 120 may each engage one or more slots 300 formed in one of the shelf ladders 126 to cantilever the adjustable shelf 120 to a pair of shelf ladders 126. As such, the slots 300 formed in the shelf ladders 126 provide a plurality of shelf mounting positions for the adjustable shelves 120. In the illustrative embodiment, the slots 300 formed in the shelf ladders 126 (and, hence, the shelf mounting positions) are spaced approximately one inch apart. It will be appreciated that other configurations for the spacing of the slots 300 and the shelf mounting positions are possible.

In the illustrative embodiment of the refrigerator 100, one or more of the shelf ladders 126 may include a housing 304 positioned behind the shelf ladder(s) 126, as illustrated in FIG. 3. As described further below, the housing 304 supports at least one electrical connector 306 for supplying power to an adjustable shelf 120. In some embodiments, the housing 304 may support an electrical connector 306 disposed behind each slot 300 and, thus, corresponding to each of the plurality of shelf mounting positions. It will be appreciated that, where each adjustable shelf 120 engages two or more shelf ladders 126, only some of the shelf ladders 126 may include a housing 304 supporting one or more electrical connectors 306. In some embodiments, the housing 304 may include a number of protrusions 308 that snap into corresponding holes 310 on the shelf ladder 126 to secure the housing 304 behind the shelf ladder 126. In other embodiments, the housing 304 may be secured to one of the shelf ladders 126 using screws, bolts, rivets, adhesive, or other fixation mechanisms.

As described above (with reference to FIG. 2B), a mounting bracket 204 of an adjustable shelf 120 may include a number of tabs 206 configured to engage a number of slots 300 of one of the shelf ladders 126. In the illustrative embodiment of FIG. 3, an upper tab 206 may have a hook shape that rests on a lower edge of one of the slots 300 when the adjustable shelf 120 is removably mounted in one of the shelf mounting positions. The mounting bracket 204 may also have a lower tab 206 that extends through an adjacent slot 300 of the shelf ladder 126. As noted above, the mounting bracket 204 may include multiple upper tabs 206 and/or multiple lower tabs 206 extending from the body of the mounting bracket 204, any of which may carry one or more conductors 208. When one of the lower tabs 206 extends through a slot 300 defined in the shelf ladder 126 (when the adjustable shelf 120 is removably mounted in one of the shelf mounting positions), a conductor 208 carried by the lower tab 206 may engage an electrical connector 306 disposed behind the slot 300 to provide power to any lighting devices 210 carried by the adjustable shelf 120. It is contemplated that each mounting bracket 204 (and each tab 206 thereof) may carry any number of conductors 208 for interfacing with any number of electrical connectors 306 supported by the housing 304.

Figure 4A:
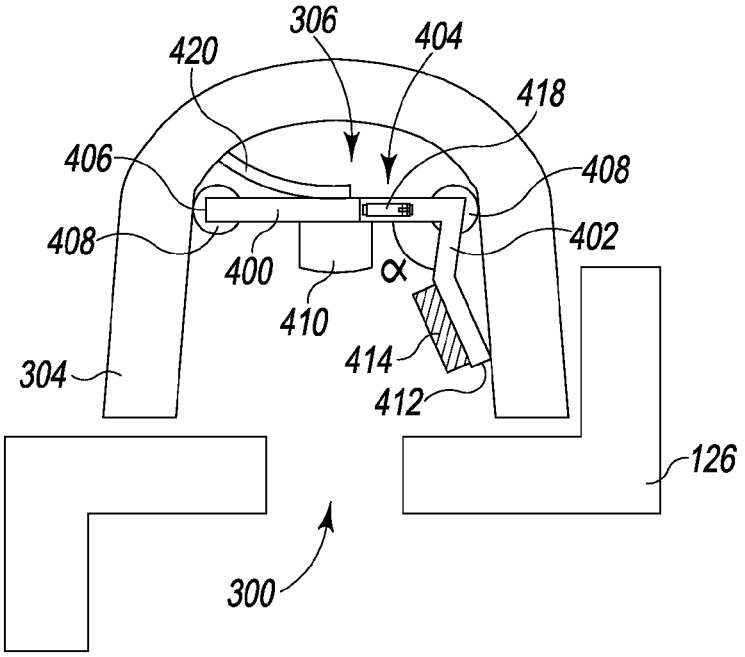
FIG. 4A is a top plan view of one embodiment of an electrical connector of the refrigerator appliance of FIG. 1.
Figure 4B:
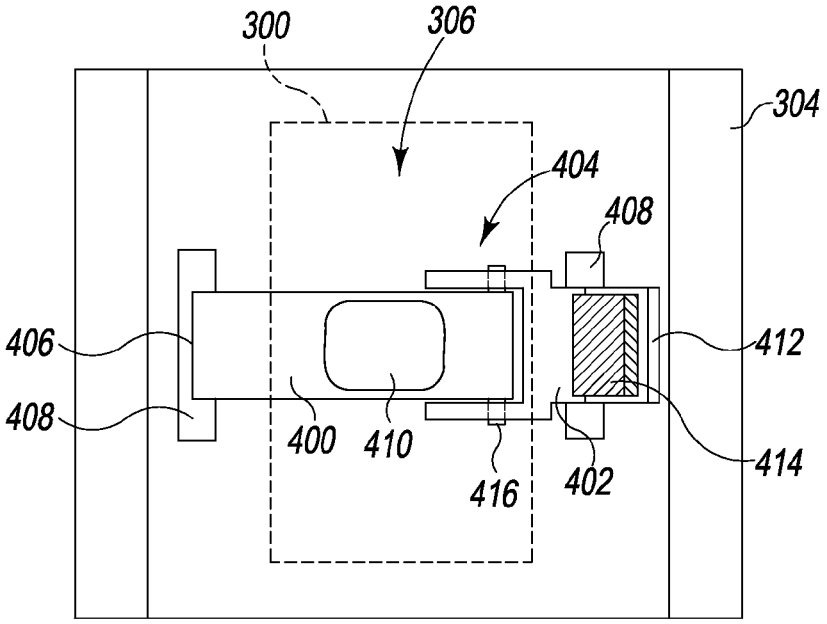
FIG. 4B is a front view of the electrical connector of FIG. 4A, showing a slot of the shelf ladder in phantom.

As shown in the illustrative embodiment of FIGS. 4A and 4B, the electrical connector 306 includes two levers 400, 402 that are coupled to one another at a sliding joint 404. In this illustrative embodiment, the lever 400 is generally planar and is pivotably coupled to the housing 304 at a lateral end 406 of the lever 400. The lateral end 406 of the lever 400 may be coupled to the housing 304 in any manner that permits pivoting of the lever 400. As shown in FIGS. 4A and 4B, the lateral end 406 of the lever 400 is coupled to the housing 304 via a hinge 408. A medial end of the lever 400 (opposite the lateral end 406) is coupled to the lever 402 at the sliding joint 404. The lever 400 also includes a protrusion 410 extending toward the slot 300. The protrusion 410 may be integrally formed with the body of lever 400 or may be coupled to the body of lever 400. As described further below, with reference to FIG. 5, the protrusion 410 of the lever 400 is configured to engage a tab 206 of a mounting bracket 204 that extends through the slot 300.

In the illustrative embodiment, the lever 402 of the electrical connector 306 includes two sections that are disposed at an angle to one another. This angle (denoted a in FIG. 4A) may be any angle other than 180 degrees (i.e., the two section of lever 402 disposed at an angle to one another are non-parallel). The lever 402 is pivotably coupled to the housing 304 at a location where the two sections of lever 402 meet. The lever 402 may be coupled to the housing 304 in any manner that permits pivoting of the lever 402. As shown in FIGS. 4A and 4B, the lever 402 is coupled to the housing 304 via a hinge 408. The lateral end 412 of the lever 402 carriers an electrical contact 414. The electrical contact 414 is electrically coupled to a power circuit (not shown) of the refrigerator 100 and is configured to supply power to an adjustable shelf 120 that engages the electrical connector 306. A medial end of the lever 402 (opposite the lateral end 412) is coupled to the lever 400 at the sliding joint 404.

The medial end of the lever 400 and the medial end of the lever 402 may be coupled to one another in any suitable fashion. In the illustrative embodiment shown in FIGS. 4A and 4B, the levers 400, 402 are coupled to one another at via a sliding joint 404. The lever 400 includes two protrusions 416 extending from its medial end. The lever 402 includes two tracks 418 formed in its medial end. As shown in FIG. 4A, the tracks 418 are illustratively formed in a pair of spaced apart arms extending from the medial end of the lever 402. Each of the protrusions 416 engages one of the tracks 418, coupling the levers 400, 402 to one another, but allowing a sliding movement between the levers 400, 402.

The electrical connector 306 also includes a resilient member 420 that biases the lever 400 toward the slot 300 in the shelf ladder 126. In the illustrative embodiment of FIG. 4A, the resilient member 420 may be comprised of a deformable metal that may be bent out of shape by sufficient force, but that returns to its original shape in the absence of such force. It is also contemplated that, in other embodiments, the lever 400 may be spring-loaded by other mechanisms (e.g., the resilient member 420 may be one or more traditional springs). In the absence of a sufficient opposing force, the resilient member 420 maintains the lever 400 (and, hence, the lever 402) in the position shown in FIGS. 4A and 4B.

Figure 5:
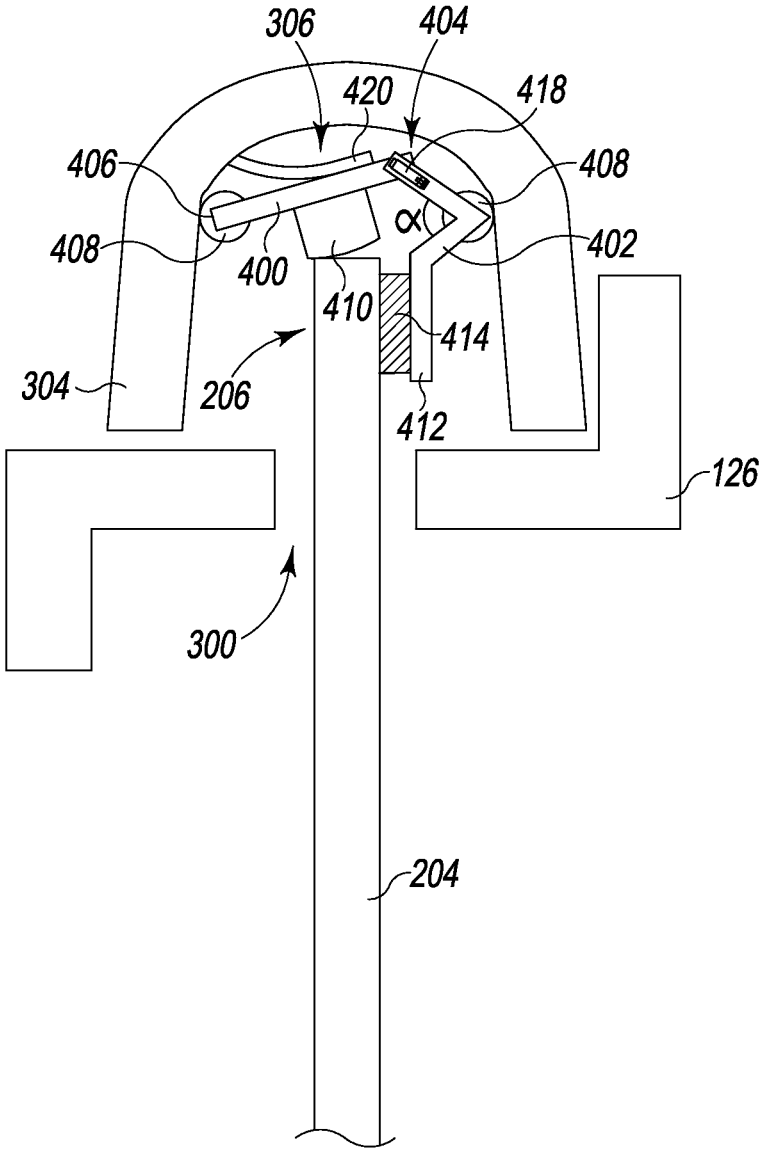
FIG. 5 is a top plan view of a mounting bracket of an adjustable shelf engaged with the electrical connector of FIGS. 4A and 4B.

The engagement of a mounting bracket 204 of an adjustable shelf 120 with the electrical connector 306 of FIGS. 4A and 4B is illustratively shown in FIG. 5. As described above, an adjustable shelf 120 may be removably mounted in the refrigerator by engaging a mounting bracket 204 of the adjustable shelf 120 with a number of slots 300 formed in a shelf ladder 126. In the illustrative embodiment, the adjustable shelf 120 may be cantilevered on the shelf ladder 126 by engaging a hook-shaped upper tab 206 of the mounting bracket 204 with a lower edge of one of the slots 300 and allowing a lower tab 206 of the mounting bracket to extend through an adjacent slot 300 of the shelf ladder 126. FIG. 5 illustrates the lower tab 206 of the mounting bracket 204 extending through the slot 300 when the adjustable shelf 120 is cantilevered on the shelf ladder 126.

As the adjustable shelf 120 is positioned, the tab 206 of the mounting bracket will pass through the slot 300 and enter the housing 304. When the tab 206 reaches the electrical connector 306, the tab 206 will engage the protrusion 410 of the lever 400. The weight of the adjustable shelf 120 (or a portion thereof) will oppose the biasing force of the resilient member 420, causing the resilient member 420 to deform and the lever 400 to pivot on the hinge 408. As the lever 400 pivots, the interaction of the lever 400 and the lever 402 at the sliding joint 404 will cause the lever 402 to also pivot on its hinge 408. In this way, the lever 400 serves as an actuator of the electrical connector 306, causing the lever 402 to automatically move when the lever 400 is moved. This action results in the electrical contact 414 approaching and engaging the adjustable shelf 120.

When the electrical connector 306 is in the engaged position shown in FIG. 5, the electrical contact 414 may interface with one or more conductors 208 carried by the tab 206 of the mounting bracket 204. In other words, when the adjustable shelf 120 engages the electrical connector 306, the electrical contact 414 will engage and may supply power to the conductor(s) 208. As will be appreciated from FIG. 5, the surface of the tab 206 that engages the lever 400 and the surface of the tab 206 that interfaces with the electrical contact 414 are not the same surface, but are perpendicular to one another. As such, the electrical contact 414 is not directly subject to the weight of the adjustable shelf 120. Nevertheless, the weight of the adjustable shelf 120 contributes to a good electrical connection between the electrical contact 414 and the conductor(s) 208 due to the actuation of lever 400.

So long as the adjustable shelf 120 remains removably mounted, the weight of the adjustable shelf 120 will maintain the electrical connector in the position shown in FIG. 5. When the adjustable shelf 120 is removed from this mounting position, the weight of the adjustable shelf 120 will be removed from the lever 400 and the tab 206 will be withdrawn through the slot 300. The resilient member 420 will then influence the lever 400 to pivot back toward the slot 300 (to the position shown in FIGS. 4A and 4B). As the lever 400 pivots, the interaction of the lever 400 and the lever 402 at the sliding joint 404 will cause the lever 402 to also pivot on its hinge 408 (once again, to the position shown in FIGS. 4A and 4B). In this disengaged position, the lever 402 and the electrical contact 414 carried thereon will remain clear of the adjustable shelf 120, allowing easier installation and removal of the adjustable shelf 120.

Figure 6:
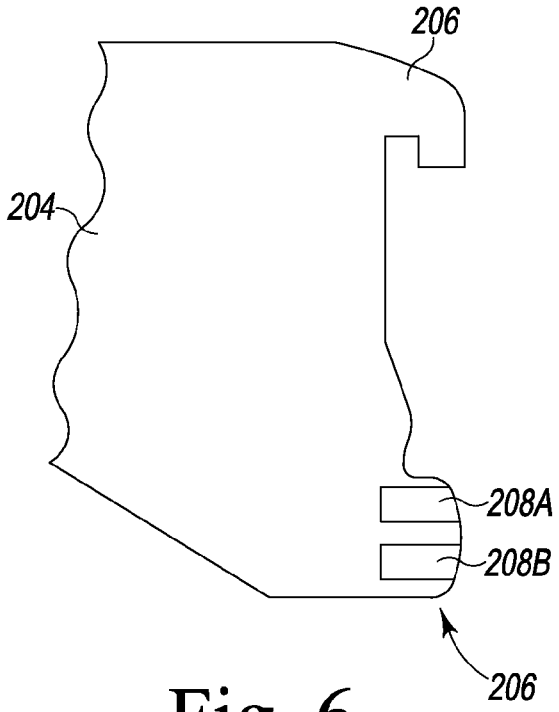
FIG. 6 is a partial side view of another embodiment of a mounting bracket of the refrigerator appliance of FIG. 1.
Figure 7:
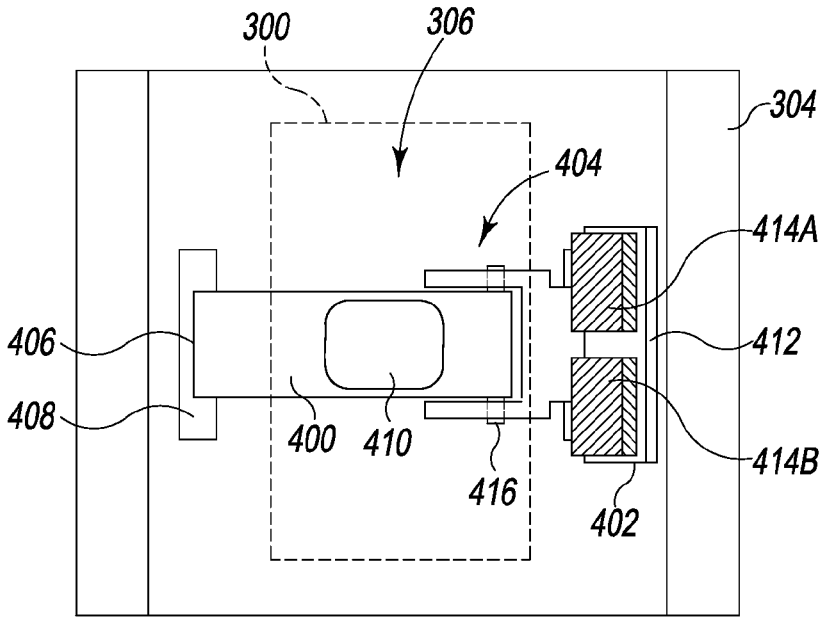
FIG. 7 is a front view of another embodiment of an electrical connector, showing a slot of the shelf ladder in phantom.

Referring now to FIGS. 6 and 7, additional illustrative embodiments of a mounting bracket 204 and an electrical connector 306, respectively, are shown. The mounting bracket 204 illustrated in FIG. 6 is generally similar in construction to the mounting brackets 204 described above, with the exception that this mounting bracket 204 includes two conductors 208A, 208B carried by the lower tab 206. As mentioned above, it is contemplated that any number of conductors 208 may be included on the tabs 206 of the mounting bracket 204. In the illustrative embodiment of FIG. 6, the two conductors 208A, 208B may each be electrically coupled to a different LED 210 (or set of LEDs 210).

The electrical connector 306 illustrated in FIG. 7 is generally similar in construction to the electrical connectors 306 described above, with the exception that the lateral end 412 of the lever 402 carries two electrical contacts 414A, 414B. When the mounting bracket 204 of FIG. 6 engages the electrical connector 306 of FIG. 7, the electrical contact 414A may interface with the conductor 208A, while the electrical contact 414B may interface with the conductor 208B. The illustrative embodiment of FIGS. 6 and 7 may thus provides multiple, independent electrical circuits for supplying power to an adjustable shelf 120 (and any lighting devices 210 carried thereon).

In some embodiments, the two electrical contacts 414A, 414B may supply power at different current levels. For instance, one electrical contact 414A may supply power at a current level of 100 milliamps, while the other electrical contact 414B supplies power at a lower current level, such as, for example, 30 or 50 milliamps. Where the two electrical contacts 414A, 414B are configured to supply power to each adjustable shelf 120 at different current levels (e.g., 30, 50, or 100 milliamps), the adjustable shelves 120 may carry different types of LEDs 210. For instance, some adjustable shelves 120 may carry white LEDs 210, other adjustable shelves 120 may carry color LEDs 210, and still other adjustable shelves 120 may carry both white and color LEDs 210. Each adjustable shelf 120 may then electrically couple each of the LEDs 210 to the appropriate electrical contact 414 to receive power at the appropriate current level for that LED 210.

There are a plurality of advantages of the present disclosure arising from the various features of the systems, apparatus, and methods described herein. It will be noted that alternative embodiments of the systems, apparatus, and methods of the present disclosure may not include all of the features described yet still benefit from at least some of the advantages of such features. Those of ordinary skill in the art may readily devise their own implementations of the systems, apparatus, and methods that incorporate one or more of the features of the present disclosure and fall within the spirit and scope of the present invention as defined by the appended claims.

The invention claimed is:

1. An electrical connector configured to engage an adjustable refrigerator shelf within a refrigerator, the electrical connector comprising:

a first lever having a first end and a second end opposite the first end, the first lever being movable from a first position to a second position when a mounting bracket of the adjustable refrigerator shelf engages the first lever; and a second lever having a first section and a second section disposed at an angle other than 180 degrees to the first section, the second lever being movable from a disengaged position to an engaged position in which a first electrical contact carried by the second section is configured to engage the mounting bracket to supply power to the adjustable refrigerator shelf when the adjustable refrigerator shelf is engaged with the electrical connector;

wherein the first end of the first lever is coupled to the first section of the second lever such that movement of the first lever form the first position to the second position that occurs upon engagement of the electrical connector with the adjustable refrigerator shelf causes movement of the second lever from the disengaged position to the engaged position.

2. The electrical connector of claim 1 further comprising a resilient member that biases the first lever toward the first position and wherein the electrical connector is spaced within an electrical connector housing.

3. The electrical connector of claim 1, wherein the first end of the first lever includes a protrusion extending therefrom which engages a track formed in the first section of the second lever.

4. The electrical connector of claim 2, wherein the protrusion is integrally formed with the first lever and wherein the first end engages an interior surface of the electrical connector housing.

5. The electrical connector of claim 1 further comprising:

a housing supporting the electrical connector and having a shelf mounting bracket receiving slot formed therein; and the first electrical contact carried by the second section of the second lever is configured to interface with a first conductor carried by a tab of a shelf mounting bracket extending through the slot when the mounting bracket is cantilevered on a shelf ladder of a refrigerator.

6. The electrical connector of claim 5 further comprising a second electrical contact carried by the second section of the second lever, the second electrical contact being configured to interface with a second conductor carried by the tab when the mounting bracket is cantilevered on the shelf ladder.

7. The electrical connector of claim 6, wherein the first and second electrical contacts are configured to supply power to the adjustable refrigerator shelf at different current levels.

8. The electrical connector of claim 5, wherein:

the first lever is pivotably coupled to the housing at the second end of the first lever; and the second lever is pivotably couple to the housing at a location where the first and second sections of the second lever meet.

9. The electrical connector of claim 1, wherein the first lever is substantially planar and pivotably coupled to an electrical connector housing and wherein the electrical connector is spaced within the electrical connector housing.

10. The electrical connector of claim 9 further comprising a hinge that engages the first lever and the electrical connector housing to pivotably couple the first lever with the electrical connector housing.

11. The electrical connector of claim 1, wherein the first lever and second lever are coupled by a sliding joint.

12. The electrical connector of claim 11, wherein the second lever further comprises a medial end and two tracks forming in its medial end and the first lever comprises a medial end having two protrusions extending from its medical end and wherein the two protrusions each engage one of the two tracks to form the sliding joint.

13. The electrical connector of claim 1, wherein the first lever is hingedly connected to an electrical connector housing and the electrical connector further comprises a resilient member that biases the first lever toward a slot in the electrical connector housing.

14. The electrical connector of claim 13, wherein the resilient member comprises a deformable metal capable of being bent out of shape by a sufficient force, but that returns to its original shape in the absence of such force.

15. The electrical connector of claim 13, wherein the resilient member comprises one or more springs.

16. A method comprising:

removably mounting an adjustable shelf in a temperature-controlled compartment of a refrigerator such that a weight of the adjustable shelf automatically moves an electrical contact of the electrical connector of claim 1 from a disengaged position to an engaged position, wherein the electrical contact supplies power to the adjustable shelf when in the engaged position.

17. The method of claim 16, wherein the step of removably mounting the adjustable shelf in the temperature-controlled compartment of the refrigerator comprises cantilevering a mounting bracket of the adjustable shelf on a shelf ladder disposed in the temperature-controlled compartment and wherein the electrical connector is in a housing.

18. The method of claim 16, wherein the step of cantilevering the mounting bracket of the adjustable shelf on a shelf ladder mounted within the temperature-controlled compartment of the refrigerator causes a tab of the mounting bracket to extend through a slot formed in the shelf ladder and to engage the electrical connector.

19. An electrical connector configured to engage an adjustable refrigerator shelf within a refrigerator, the electrical connector comprising:

an electrical connector housing defining an interior of the electrical connector and a refrigerator shelf mounting bracket receiving slot;

a first lever having a first end and a second end opposite the first end wherein the first lever and a second lever are engaged with one another by a sliding joint;

wherein the second lever has a first section and second section disposed at an angle such that the first section and the second section of the second lever are not parallel to one another;

wherein the first end of the first lever is coupled to the first section of the second lever such that movement of the first lever from a first position to a second position causes movement of the second lever from a shelf disengaged position to a shelf engaged position; and wherein the first lever is substantially planar and pivotably coupled to the electrical connector housing.

20. The electrical connector of claim 19, wherein the second lever further comprises a medial end and the first lever further comprises a medial end and one of the first lever or the second lever further comprises two tracks formed in its medical end and the other lever further comprises two tracks formed in its medial end and the other lever further comprises two protrusions extending from its medial end which, when engaged to one another form the sliding joint.

* * * * *